US006752566B2

(12) United States Patent
Smith

(10) Patent No.: US 6,752,566 B2
(45) Date of Patent: Jun. 22, 2004

(54) EXO-LIFT

(75) Inventor: William Bruce Smith, Yuba City, CA (US)

(73) Assignee: Works R&D, Inc., Yuba City, CA (US)

( * ) Notice: Subject to any disclaimer, the term of this patent is extended or adjusted under 35 U.S.C. 154(b) by 0 days.

(21) Appl. No.: 10/455,117

(22) Filed: Jun. 4, 2003

(65) Prior Publication Data

US 2003/0194272 A1 Oct. 16, 2003

Related U.S. Application Data

(63) Continuation-in-part of application No. 09/682,546, filed on Sep. 19, 2001, now Pat. No. 6,595,718.

(51) Int. Cl.[7] ..... E01C 19/52
(52) U.S. Cl. ..... 404/75; 404/73
(58) Field of Search ..... 404/72, 73, 75, 404/83, 90, 99, 100, 34; 299/36.1

(56) References Cited

U.S. PATENT DOCUMENTS 2,794,336 A * 6/1957 Ballou ..... 52/705
3,712,014 A * 1/1973 Waerner ..... 52/707
3,873,147 A * 3/1975 Annable et al. ..... 294/89
4,018,470 A * 4/1977 Tye ..... 294/89
4,194,853 A * 3/1980 Barth et al. ..... 404/73
4,320,985 A * 3/1982 Kleinemas ..... 404/99
4,583,879 A * 4/1986 Hofman ..... 404/73
5,561,956 A * 10/1996 Englekirk et al. ..... 52/223.13
5,649,782 A * 7/1997 Frohlich et al. ..... 403/301
6,102,607 A * 8/2000 Kintscher ..... 403/291
6,102,614 A * 8/2000 Yukawa ..... 404/35
6,230,447 B1 * 5/2001 Pribyl et al. ..... 52/125.2
6,347,904 B1 * 2/2002 Knighton ..... 403/400
6,481,165 B1 * 11/2002 Romary et al. ..... 52/122.1
2003/0110715 A1 * 6/2003 Hansort ..... 52/125.6

* cited by examiner

*Primary Examiner*—Thomas B. Will
*Assistant Examiner*—Alexandra K. Pechhold
(74) *Attorney, Agent, or Firm*—Kolisch Hartwell P.C.

(57) ABSTRACT

The current invention includes a system and method for removing and replacing rigid slabs in pavement sections of highways, bridge decks, airport runways, and various other similar structures. The method may utilize a lifting frame which acts to remove damaged slabs in a single operation also is used to reinstall a replacement slab or panel while acting as external reinforcement and also serving to align and secure the replacement panel in the void left by the removed section while under bedding material is installed and cured under the new panel.

35 Claims, 10 Drawing Sheets

FIG.17
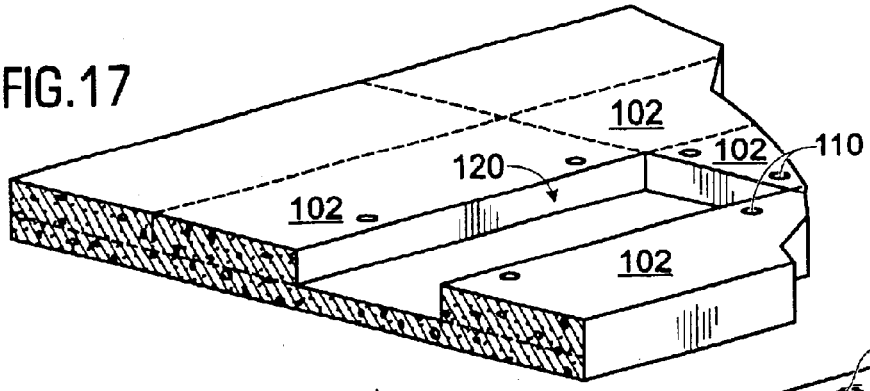
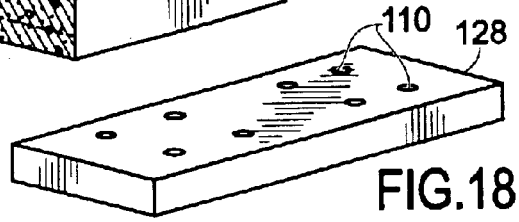
FIG.18
FIG.19
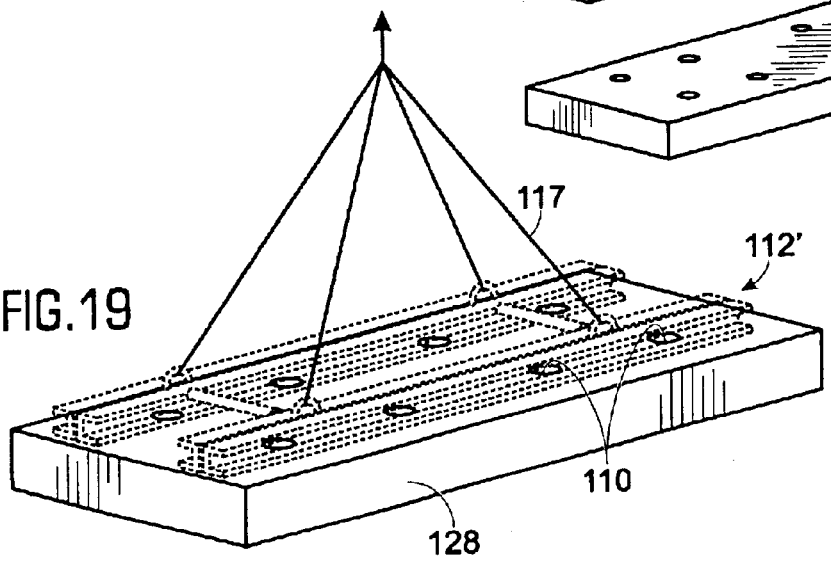
FIG.20
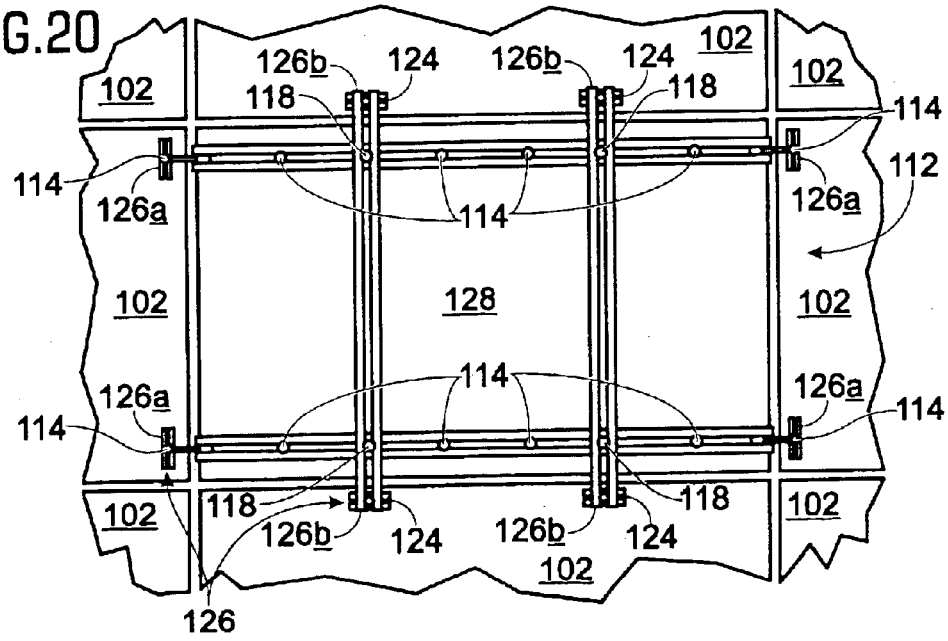

EXO-LIFT

CROSS-REFERENCE TO RELATED APPLICATION

This application is a continuation-in-part of U.S. patent application Ser. No. 09/682,546, entitled "Exo-Lift," which was filed on Sep. 19, 2001 now U.S. Pat. No. 6,595,718 by inventor William Bruce Smith, the entire disclosure of which is herein incorporated by reference.

BACKGROUND OF INVENTION

In the rigid pavement industry, concrete failures often occur in isolated areas. In the past, saw-cutting failed slabs in multiple smaller sections and then individually removing these sub-sections separately accomplished removal of these damaged slabs. This has become known as the "non-impact" method of removal. An alternative to this "non-impact" method is known as the "impact method" in which an air compressor-powered jackhammer mounted on a backhoe is used to "rubble-ize" the damaged slab. This rubble must then be removed, and the underlying base must be repaired before the replacement slab can be installed, costing more time and money. The non-impact method spares the structural integrity of the base layer of the rigid pavement, while the impact method destroys the structural soundness of the base material. The non-impact method is preferred due to the added labor, cost and time of repairing the damaged base material when the impact method is used.

At this point the concrete is placed, finished and cured. Depending on the type of concrete used, curing could require hours to days before reaching design strength and being put back into service. Because the economic cost of stopping vehicular or aircraft traffic, and the inconvenience to the public in shutting down the transportation system, choices had to be made between closing lanes of highways or airport landing fields for long periods of time or, alternatively, using very expensive concrete products which cure in a few hours. These fast setting concretes can be so sensitive and unpredictable that they sometimes set up while still in the transit mix truck; or if certain conditions change slightly they can take 12 hours to set up instead of the usual four to six hours. Another great concern is that if the repair location is more than a short haul distance from a concrete production plant fast-setting concrete mixes were infeasible because of their short set times. One alternative is to set up portable batch plants for on-site preparation of fast-setting concrete, but additional costs are associated with this operation. For these reasons, this method of repair is extremely expensive and problematical.

An alternative to the fast-setting concrete method is to place pre-cast slabs into the holes from which the damaged panels were removed. Then an expanding foam injection process raises the new panel into position. Both methods (fast-setting concrete or pre-cast panels) have saved time, also saving effort, while allowing the repairs to be done in an eight hour shift in the middle of the night, or at a time when the highway, runway, or bridge can be closed or partially shut down. Because of the expense of fabricating and hauling pre-cast panels to the site and using the expensive expanding foam agents, the latter method proved more expensive than using fast-setting concrete but less problematical.

SUMMARY OF INVENTION

This novel invention solves many of the problems of the prior art methods of removing and replacing damaged rigid pavement sections.

The novelty of this invention is in the way it is used to remove, and replace various rigid pavements, in particular, the concrete used in highways and runways at airports. This invention utilizes an external framing (and thus the present frame may be referred to as an "Exo-Lift" frame, as in "exo-skeletal"), a structural frame to remove broken concrete slabs as single units, and replace the same with new panels. It further acts to externally reinforce the new panels during lifting and aligning in position. It maintains structural support for the replacement slab during its final placement and connection to adjacent slabs, structures, and various other items depending on its application. Support is also maintained while the replacement slab is being bedded and anchored in cementitious or other properly chosen fast-setting materials.

Initially, using a novel tilted guide platform for mounting the concrete saw at a small angle to the perpendicular modifies the saw-cutting process. This allows the concrete joint to be double sawn, once vertically and once at a small angle, to give the concrete slab being removed a beveled edge, which allows it to be removed in a vertical direction without binding to and possibly damaging the rigid concrete pavement to remain. This provides significant savings in time and monetary cost.

After saw cutting around the area to be replaced, the frame is placed over the area of the broken-up concrete. Because it is important to preserve the integrity of the layer just below the concrete layer (which is typically aggregate base, cement treated base, asphalt base, Lean concrete or some similar base material), the broken pieces of slab are individually drilled for anchor installations. The new frame is adjustable both in width and length to accommodate any configuration of cracks in the damaged pavement. Once the frame is bolted to the broken slab, the slab can be removed as a single unit by crane. This saves much time and allows the unit to be hauled off the site and out of the way quickly and efficiently. This frame can save an estimated 10 to 60 percent of the usual time over the current demolition and piecemeal removal methods. The base material is essentially undisturbed, alleviating the need to repair it and thus saving more time and money.

The new frame allows the choice of manufacturing pre-cast replacement panels efficiently at a pre-cast yard. The frame could be attached to these panels at the site of manufacture to facilitate their transportation to the job site. Alternatively, the replacement slabs can be cast at or near the job site. Since the frame reduces the moment loading of the replacement slabs during lifting, transport and installation, it is no longer necessary to include internal steel reinforcement in their manufacture to enable them to withstand the stresses of shipping, lifting, and installation (which are much greater than the stresses encountered during the actual traffic loading of the slab), thus saving time and monetary expense.

Now the slab with the frame attached can be crane-lifted into place, where it is aligned with the pavement surrounding it by the extensions of the longitudinal and transverse beams. The replacement slab will also be supported so that it can leave a small void under the new slab. This void produces the prism for the new base support layer, which can be filled with a very small amount of fast-setting grout. The grout can be mixed at the site with no transit mix trucks required. Only 5 to 10 percent of the original volume of the slab would be required to be replaced with this fast setting material. Because of the small volume of materials required, bagged products would become economically feasible for use. (Bagged products being those whose performance and specifications are documented, proven and generally accepted in the industry as acceptable for use in applications similar to the present application.) The use of these "bagged products" opens the door to remote use of this method where only a small mixing drum is necessary to mix products which have a much higher level of quality control inherent in their production. Costs ranging several orders above the fast setting concrete mixes are still economic and actually preferable because there is no question as to material consistency and the water addition is observable at the site by the inspector. Products do not need to be hauled, so much "hotter" mixes—those that set much faster—can be used without problems occurring such as might be encountered with a ready-mix truck hauling over a distance, or a delay occurring in unloading a truck. Such delays sometimes cause the mix to set up in the truck before it gets unloaded. This is known to happen, and it increases costs significantly. It also increases down time, causing major problems for the facility users. When hotter mixes can be used without these problems, lane closure or runway down time can be dramatically reduced. Because the material under the slab would only need to meet a small percentage of the strength of materials which were used to support the surface load, the time before which loading could be allowed would be significantly shortened. Once the grout underlying the new slab reached initial set and achieved adequate compressive strength, the present frame can be unbolted and removed and traffic loading can be resumed.

The grout can be pumped into the low side of the slab edge and will fill upward forcing out air bubbles. As the void below the slab is filled it also fills any irregularities in the base surface providing a uniformly supported replacement slab. As the grout continues to be pumped it rises to fill the voids where the rebar-to-slab splices are, and then finally the joints surrounding the replacement slab are filled to a level just below the surface. Immediately after the initial set the joints can be topped off to be flush with the adjoining surfaces. All that is left is to remove the frame and fill the connection holes with the same grout. Within minutes the replacement slab will be able to accept traffic loading.

The frame is completely collapsible into single beam sections that can typically be lifted, maneuvered and bolted in place by a two-person crew, without the use of equipment. The present frame saves both time and money over the prior art methods.

This frame advances the state of the art and science of removing, manufacturing, transporting, installing, and anchoring of concrete or other composition slabs. This opens the doors to meeting the needs of transportation, on the ground and in the air, assisting engineers in overcoming many of the problems they are facing and those, which shall become much greater. The exo-skeletal novelty opens doors, affecting many applications on virtually all fronts, including, but not limited to: slab construction and materials; transportation; installation methods; novel connection methods; handling; removal; economy; safety; downtime; inter-slab reinforcement (doweling—load transferring).

BRIEF DESCRIPTION OF DRAWINGS

FIG. 17 is an isometric view of the pavement section of FIG. 14, with the broken slab removed to expose a hole or void.

FIG. 18 is an isometric view of a replacement slab.

FIG. 19 is an isometric view of a frame according to one embodiment of the present invention installed on the replacement slab of FIG. 18, and shown being hoisted and moved as a unit.

FIG. 20 is a top view of a frame according to another embodiment of the present invention, shown installed on the replacement slab of FIG. 18, the frame and replacement slab being positioned in the void left by removal of the broken slab shown in FIG. 16.

DETAILED DESCRIPTION

Referring to FIG. 1A Through FIG. 1E, a frame system according to one embodiment of the present invention is shown. The frame system typically includes a frame F including frame members such as upper or transverse beams 4 and lower or longitudinal beams 3. The frame members are adjustable and configurable in various shapes and sizes, as shown, and may be mounted to either a broken slab 1 or a replacement slab 2.

Figure 1A:
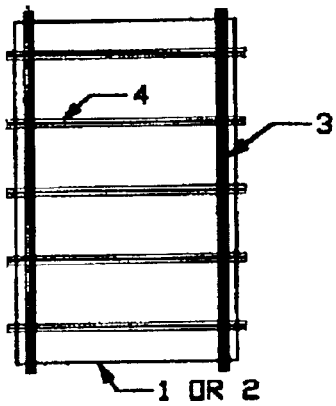
FIGS. 1A through 1E are plan views showing various possible configurations of longitudinal lower frame beams crossed by transverse upper frame beams, both overlying an existing saw cut portion of rigid pavement to be removed, or alternately overlying the replacement panel joint outline.
Figure 6:
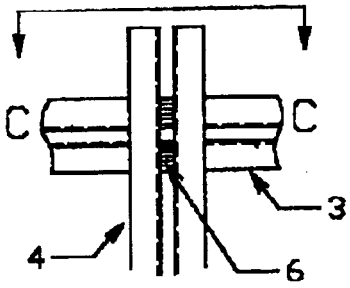
FIG. 6 is an enlarged top view of the intersection of upper and lower beams along with a section view showing the pinned connection between upper and lower beams 3 and 4.

The frame members may be arranged in a wide variety of configurations. This is typically achieved using a plurality of selectively releasable pinned connections between the frame members, as shown in FIG. 6, which may be inserted at suitable locations through channels formed along the length of each frame member. FIG. 1A shows a typical rectangular shape, although parallelogram or skewed frame shapes may be required to fit skewed slabs that exist in some highway pavements. This is easily accounted for by simply changing the pinning locations in the beams.

Figure 1B:
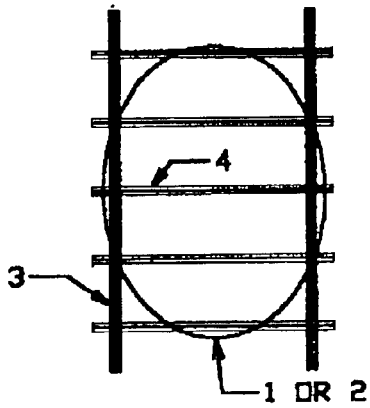
Figure 1C:
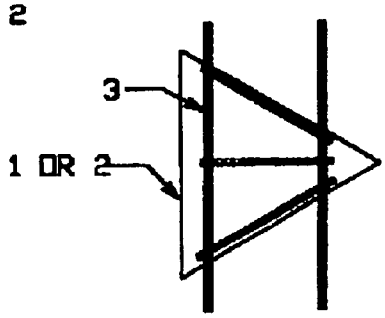
Figure 1D:
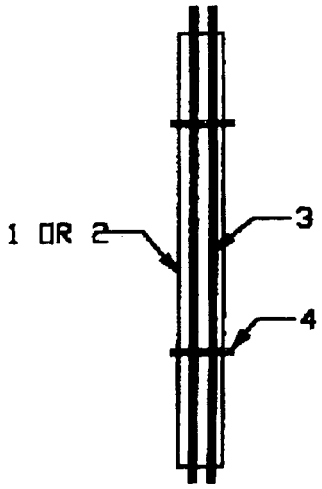
Figure 1E:
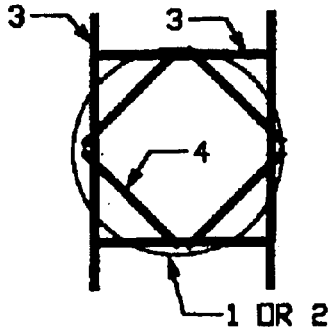

FIG. 1B depicts the frame system positioned over a curved-shape slab, such that the frame F overlaps the section to be removed. FIGS. 1C and 1D show the frame system positioned over a triangular slab and a narrow, elongate rectangular slab, respectively, further showing the adaptability in length and width proportioning and ability to accommodate various shapes of pavement slabs. FIG. 1E shows a frame embodiment in which both longitudinal and transverse lower beams 3 are used to form a rectangular shape, to which "rotated" upper beams 4 are attached. This large degree of freedom of shape size and location of beam placement relative to the outer perimeter of the broken slab 1 being removed (and also to the perimeter of the replacement slab 2) is important in that when failed or broken slabs are removed it must be possible to get an anchor into any given point of the existing pavement so that any and all sections can be attached to the frame so that a single removal operation will lift out the various sections of the broken slab.

Beams 3 and 4 can be of any material although double steel channels are used in this depiction, which are C-shaped in cross section. Member sizes will vary depending on sizes and depth of rigid pavement. Pinned connection are used to facilitate assembly and break down of the frame into multiple parts which can be lifted by two men and loaded/unloaded from a truck without necessity for wide loads. A wide variety of fastening mechanisms may be used to attach the frame members together. For example, in addition to the pin connections described above, rivets, welds, bolts and other threaded fasteners, epoxy, or other fastening mechanism may be used. Typically the fastening mechanism are releasable, and re-positionable, such that the frame members may be moved and oriented relative to each other and the slab. Thus, the pin connections and double steel channels through which they are inserted are not to be interpreted as unnecessarily limiting.

Figure 1F:
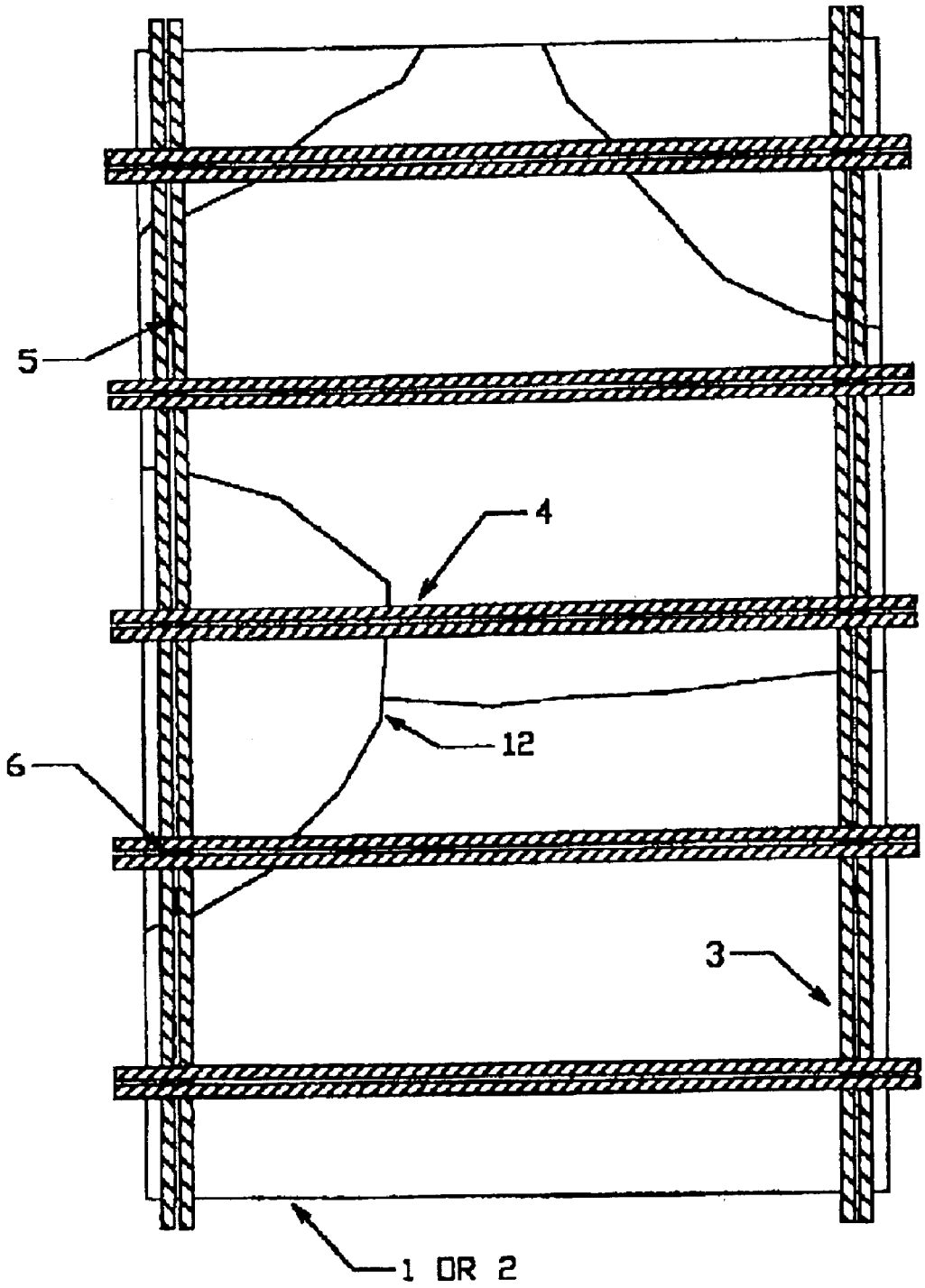
FIG. 1F is a plan view depicting the configuration shown in FIG. 1A enlarged to show the detail of spacers between doubled up steel channels and the lifting lugs between the doubled steel channels.

Referring to FIG. 1F depicts frame F installed on a pavement slab, which may be a broken slab 1 or a replacement slab 2, and thus shows the conditions of both of slab removal and installation. It will be appreciated that the invention may also be used to install new slabs, using the methods described for replacement slabs. For slab removal the lower beams 3 typically are moved out toward the edge of the broken slab 1 to increase the area to which attachments can be made. (This is the configuration shown). For slab installation the beams are typically spaced inward from the outer perimeter of the replacement slab 2 to help minimize bending moments when lifting un-reinforced replacement slabs. It should be noted that since the replacement slab is not broken into a plurality of sections, during installation of a replacement slab attachments typically go through both beams 3 and 4 at fewer connection points than during removal of a broken slab.

Figure 7:
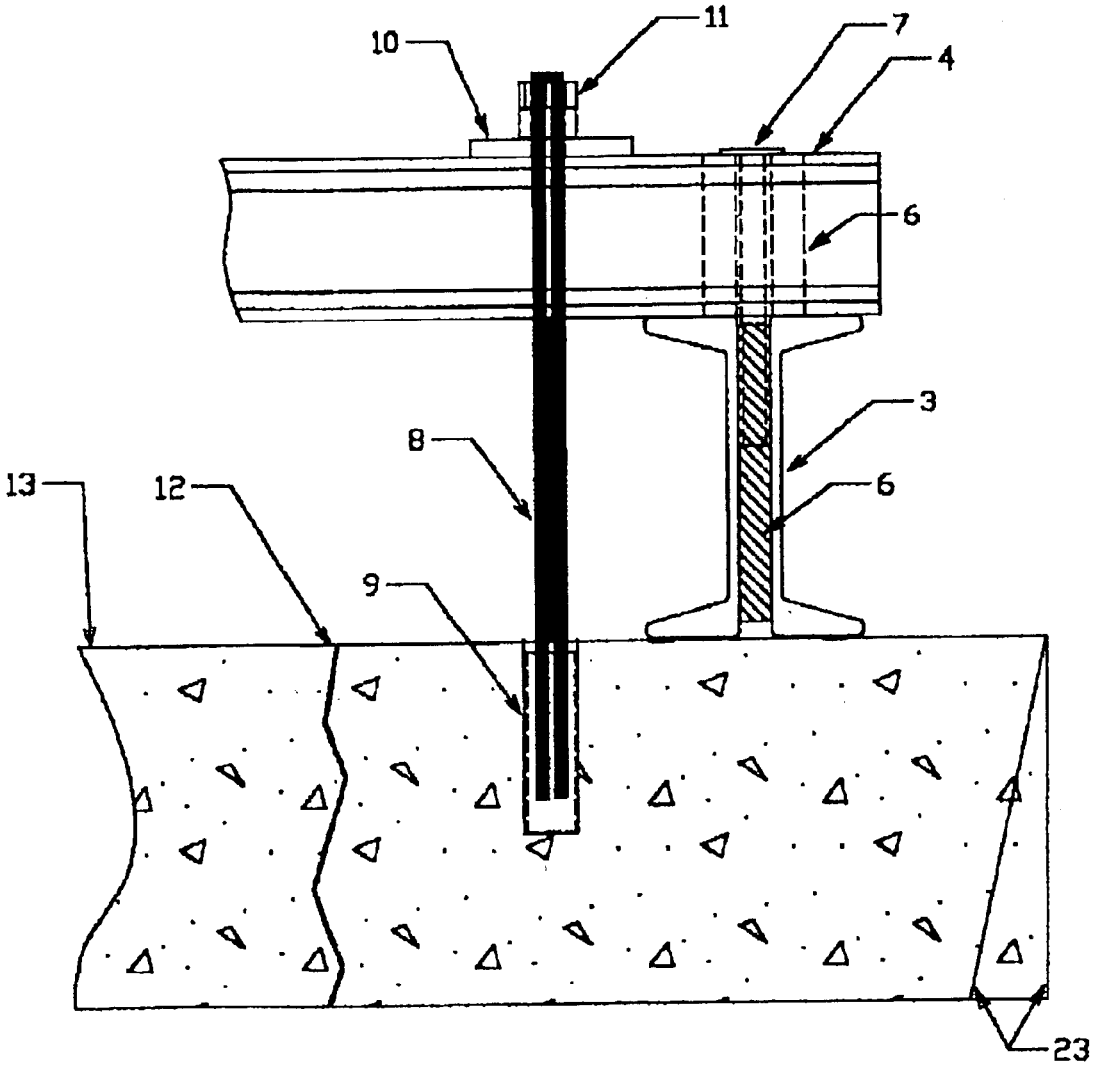
FIG. 7 is a section through an existing broken slab 13 with the frame attached to that slab set up for removal. This view also depicts the beveled saw cut 23.

Upper beams 4 are shown substantially perpendicular to and bearing on lower beams 3. Beams 3 and 4 include spacers 6 positioned between double steel channels (as used herein the term "double steel channels" refers to opposed C-shaped steel members 3*a*, 3*b*) at spaced-apart intervals, so as to provide a substantially continuous slot along the length of the beams. To connect beams 3 and 4, a user typically inserts a fastening mechanism (typically a pin connector) through the respective slot in beams 3, 4, to secure the beams to each other. The pin connector may be inserted at any suitable location in the slot along the length of the beams. This continuous slot also provides the ability to make an attachment as shown in FIG. 7 anywhere within the perimeter of the section being replaced. These spacers 6 also serve the purpose of connecting the doubled steel channels. The spacers are typically welded in place to both channels.

Figure 8:
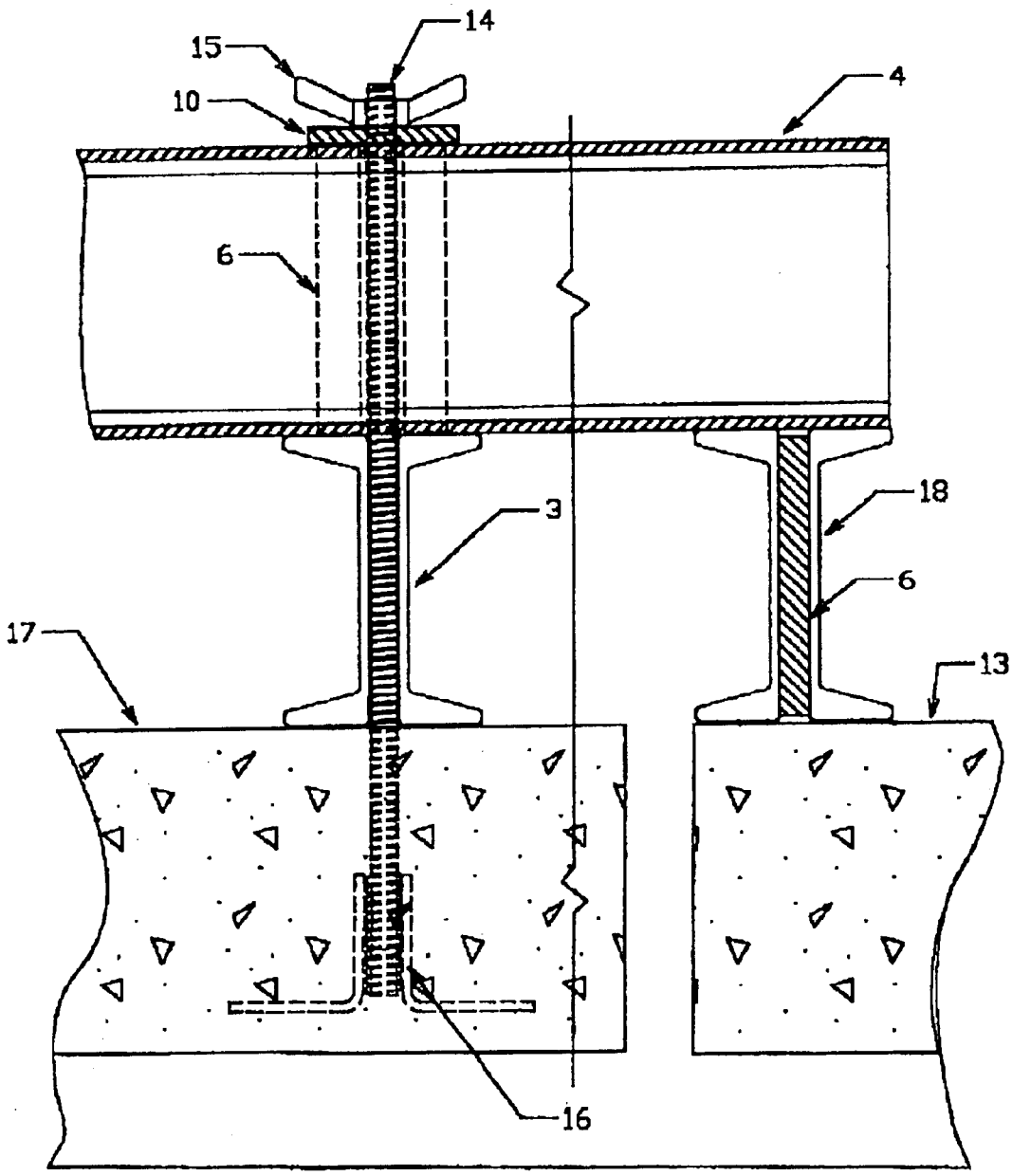
FIG. 8 is a section view through the existing rigid pavement, shown on the right side of the joint and the replacement slab shown on the left, with the frame set up for installation. This view also depicts the support beam block 18 placed under the upper beam.

As shown in FIG. 6, at the intersection of beams 3 and 4 the spacers 6 and beam surfaces may form an approximately square tube or barrel into which pin connector 7 may be inserted, to lock the beam in position. In FIG. 8, a coil rod 14 is shown installed through a barrel or tube extending through the upper beam 4 and lower beam 3. The coil rod is secured into an anchor embedded in the slab, locking the beams in position and securing the frame to the slab.

Referring again to FIG. 1, the frame system may further include a plurality of lifting lugs 5, which are welded into place between the double steel channels that form beams 3. The lifting lugs 5 are typically placed in spaced apart orientations along the length of both of the longitudinal beams 3 on the left and right sides of the slab. The lugs are placed so that when the frame is lifted using the lugs, the resulting moment in the slab is minimized by the support gained in the moment carrying capacity of the beams. Quarter points in the length of the slab may produce this result, best but conditions can vary with shape. No matter where the fractures are in the slab being removed the frame can be attached to all pieces.

Figure 2:
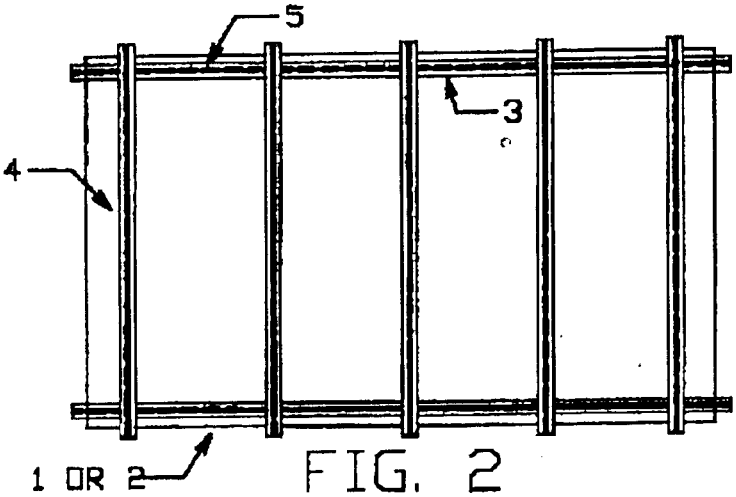
FIGS. 2, 3, and 4 are FIG. 1 shown in plan, side and end views respectively.
Figure 4:
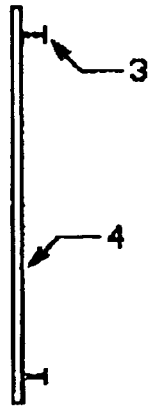
Figure 3:
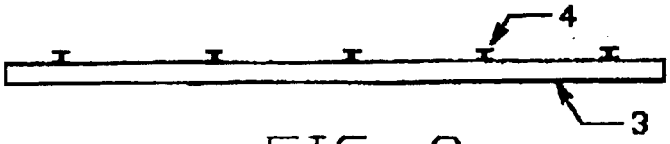

Referring to FIGS. 2, 3, and 4, a top view, side view, and end view of the frame are shown, respectively. These views are shown to help clearly represent relative positions of beams 3, 4 in the various dimensions.

Figure 5:
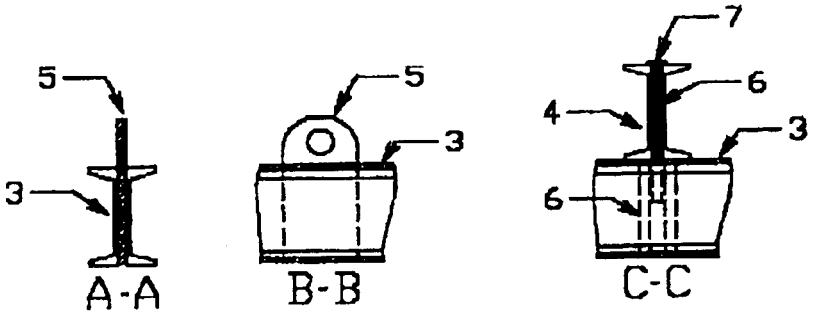
FIG. 5 is an enlarged top view of 3 at the lifting lug 5 along including a section and elevations at lifting lug 5.
Figure 5:
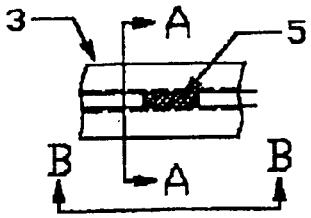

Referring to FIG. 5, lifting lug 5 is welded at all contact points between both of the steel channels composing beam 3. The lug 5 protrudes above the beam to allow easy connection of crane rigging or forklift brackets to these points.

Referring to FIG. 6 as described earlier the dually installed spacers form a convenient barrel for either the pin connector 7 (during the removal process) or the coil rod 14 (during installation process) to be installed through which gives the beams support allowing them to lock in place when the frame is loaded while lifting for removal or installation.

Figure 10:
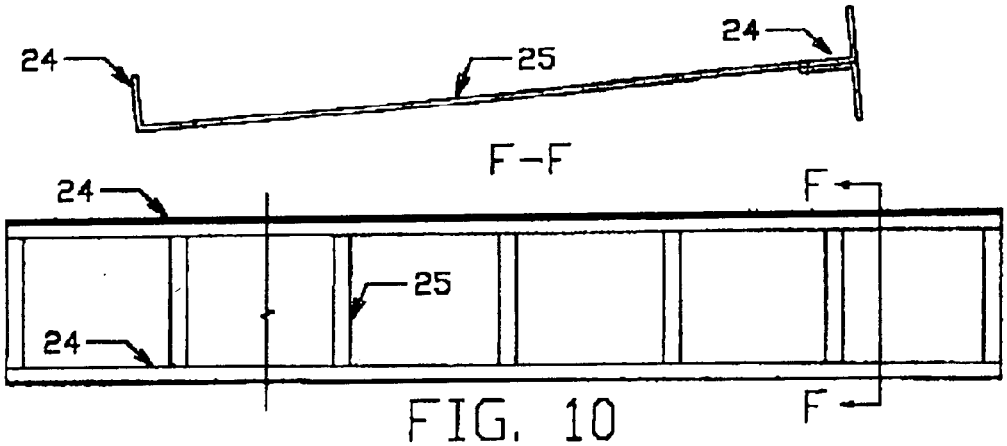
FIG. 10 is a top view and a section view of a guide rail to be used to set the concrete saw at an angle so that the beveled saw cut 23 can be made in FIG. 7.

Referring to FIG. 7, the frame is shown in a removal mode. Important to note are saw cuts in section 23 which are made prior to slab removal. These cuts are facilitated with the use of the concrete saw guide shown in FIG. 10 which allows the saw to be operated at an inclined angle. These saw cuts are made around substantially the entire perimeter of the slab to be removed. The beveled saw cut produced using the saw cutting guide frame is used to keep the slab from binding when removed. Slab binding could add undue strain on lifting equipment and could also damage adjacent slab edges thus requiring more repair and added cost. With the beveled saw cut the broken slab pieces are easily removed as a single unit.

In the removal process, typically at least one concrete anchor 9 is installed in each separate broken piece of slab.

After the anchors are set, the frame members (i.e. beams 3 and 4) can be positioned such that all anchors are directly under some portion of frame members. The frame members are typically attached to the anchors 9 in the slab via attachment assemblies. The attachment assemblies typically include a threaded fastener (such as "all-thread" 8 or coil rod 14), plate washers 10 and nuts 11, 15. By tightening the connector pins 7 and attachment assemblies, the frame can be tightened down to the slab. The combination of connector pins and attachment devices pulling down create forces on the beams 3 and 4, which naturally lock all parts into position. At this point the slab can be rigged to crane, fork lift of various other pieces of equipment and removed as a single unit. The unit can be placed on a truck and removed out of the work zone and the installation process can now begin.

Figure 12:
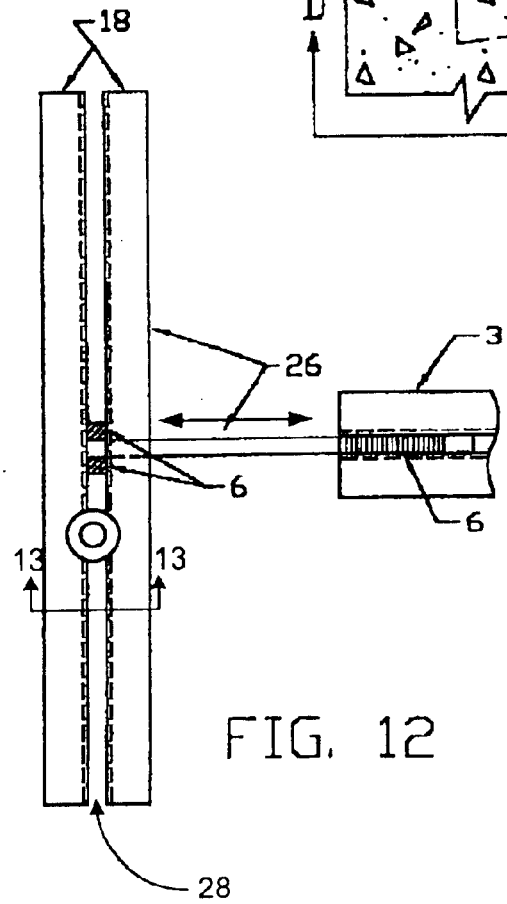
FIG. 12 is a top view of an extension that can be inserted into beams for supporting a slab.
Figure 13:
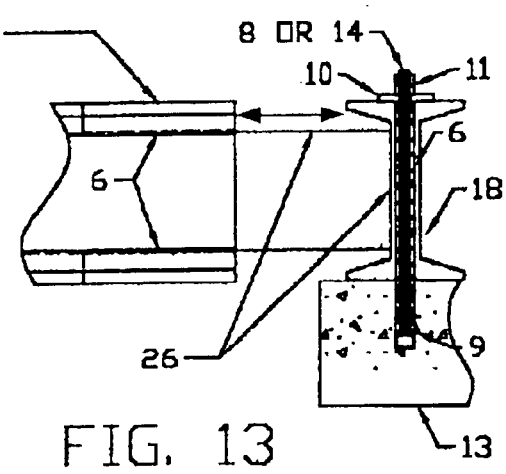
FIG. 13 is a cross sectional view of the extension of FIG. 12, inserted into beams to provide slab support.

Referring to FIGS. 12 and 13, a plurality of extensions 26 can be inserted into beams 3 and 4 to increase support of the slab against forces tending to move the slab during the installation of an underbedding material 19, such as grout or expanding foam. Each extension 26 is configured to adjustably slide in and out relative to beams 3 and 4. Each extension 26 is further provided with a slot or notch 28. Extensions 26 are configured to extend beyond the edge of the replacement slab and rest upon adjacent slabs, thereby supporting and aligning the replacement slab on the adjacent slabs. Each of the extensions is typically formed of double C-channel construction, connected by spacers 6, as described above. Anchors 9 are typically pre-installed in the adjacent slab. The installation may take place on a previous day, for example, to allow epoxy to cure. Due to the curing process and imprecision in drilling techniques, the position of the anchors may vary slightly. Further, as the replacement slab is lowered in place, the position of the frame members relative to the anchors on the adjacent slabs may vary slightly. After installation of the anchors, the frame is typically secured to the adjacent slab 13 by bolting the extension to the anchors that have been pre-installed in the adjacent slab, using threaded fasters such as all-thread 8 or coil rod 14. To accommodate for variation in position of the anchors in the adjacent slab relative to the frame, the extensions are configured to slide in and out relative to beams 3, 4, and the threaded fastener 8, 14 may be positioned an any suitable location along the length of slot 28. The result is that the extensions may be used to secure a threaded fastener to an anchor located at a wide variety of locations on the adjacent slab.

Figure 11:
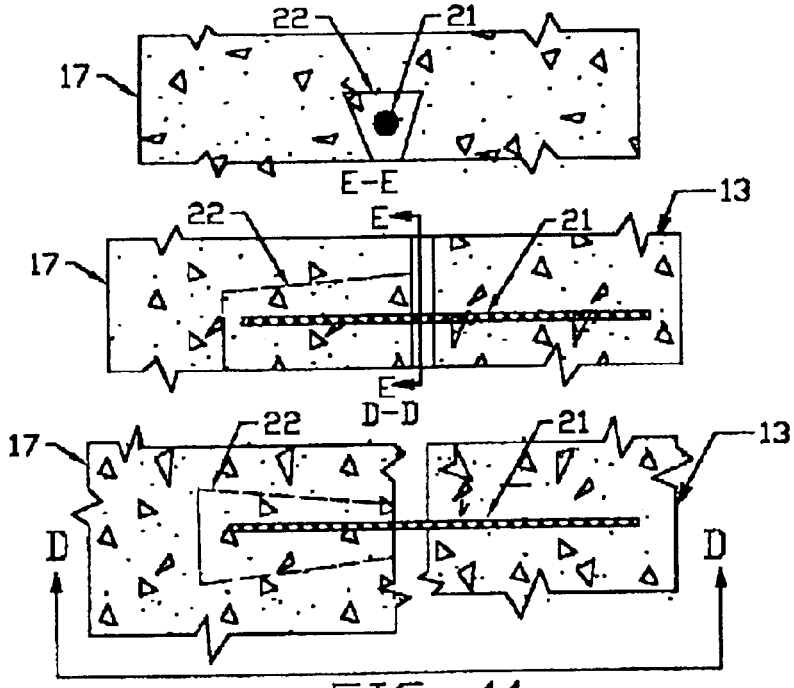
FIG. 11 is a plan view of the joint 2 at the reinforcement steel with two sections taken one transversely and one longitudinally. These three views show the reinforcement connection dowel and the reduction block-out used to make the connection between the existing and replacement rigid pavements.

Many rigid pavement designs call for steel reinforcement between adjacent slabs and many do not. This next phase is typically used with pavement designs that call for reinforcement between adjacent slabs. If inter-slab reinforcement is necessary the following approach is preferred. Referring to FIG. 11, a plan view of a new joint with a transverse section D—D and a longitudinal section E—E is shown. These sections are taken at a reinforcement tie which uses a reinforcement connection dowel 21. A hole is drilled into the existing slab 13 at a spacing that will coincide with reduction cavity block-out 22 locations in the new replacement slab sections 17 (typically 2 foot spacing). The reinforcement dowel can be slipped into the hole or can be secured in the hole with epoxy at a depth approximately one half its length (typically six to twelve inches).

The reduction cavity block-outs 22 are shaped as shown for at least two reasons. The upper portion is sloped upward and outward so that when under bedding and joint filling material 19 is pumped in (see next operation in the following paragraph), starting at the bottom, the air will be forced out and no bubbles will be left which would weaken the connection. In the plan view of FIG. 11 the sides of the reduction cavity block-out 22 are skewed to the reinforcement causing the joint filing material to be trapped into the block-out when hardened and resisting slab separation, when required by joint design, relying on not only bonding of the joint material with the new slab but also on mechanical interlocking to resist this separation. In section E—E the sides of the reduction cavity block-out are also skewed for the same reason to cause the reinforcement to be mechanically interlocked into the reduction cavity block-out. The shape is desirable as mentioned above for the general high strength which is obtained using this connection, and because it (1) resists slab separation (alternate joint designs vary on requirement to resist separation—transverse joints often do not resist separation and use a smooth slip dowel), (2) resists differential settlement, (3) resists longitudinal movement of the joint, (4) transfers load and strengthens slab perimeter condition. Now that the reinforcement connection dowel is secured the new replacement slab section is ready to be placed.

FIG. 8 shows a transverse section through a joint between the existing rigid pavement (i.e. an adjacent slab) on the right and the replacement slab on the left. The frame system is shown attached to the new slab and holding it in final position in the void created by the removed section. The frame comprised of upper and lower beams 4 and 3 is attached to the slab through the use of a cast-in-place coil rod embedded anchor 16 and a coil rod 14 which goes up through the continuous slots in beams 3 and 4 and also goes through a plate washer 10. This attachment assembly is tightened down with a coil rod wing nut 15. A minimum of four of these attachments are typically used per slab, however more may be used to lower the load at each point of connection and also to reduce the moment that the new slab (which may be either reinforced or non-reinforced by rebar). The lower beams 3 in this case run longitudinal to the greatest dimension (length dimension) of the slab and are set back in from the right slab edge in this view so that they are one fourth of the narrower dimension of the slab from the edge. This positioning when coupled with the other beam on the opposite side of the slab will balance the load and minimize moment forces in the slab. Additional attachments can be made along the beam 4 as well, to further minimize moment forces. It is contemplated that, if the new slab were to be hung in place, centered in the opening, one forth of the load of the slab would bear on each end of each of the lower beams 3. For the majority of slabs this will work, however for longer slabs the load will need to be distributed so that the slab does not tend to bow in the center. A support beam block 18 can be placed at locations as necessary to support the load, using beam 4. These intermediate supports, which are placed on opposing ends of the upper beam 4, also align the mid-span of the slab with adjoining surfaces. The overall effect of this frame support is to align and support in place the slab after the frame has been used to lift and move the slab into position. Throughout the lifting, moving and placing of the slab the moment in the slab has been kept to a minimum. Now that the slab is in its final place and held securely by its own weight.

Figure 9:
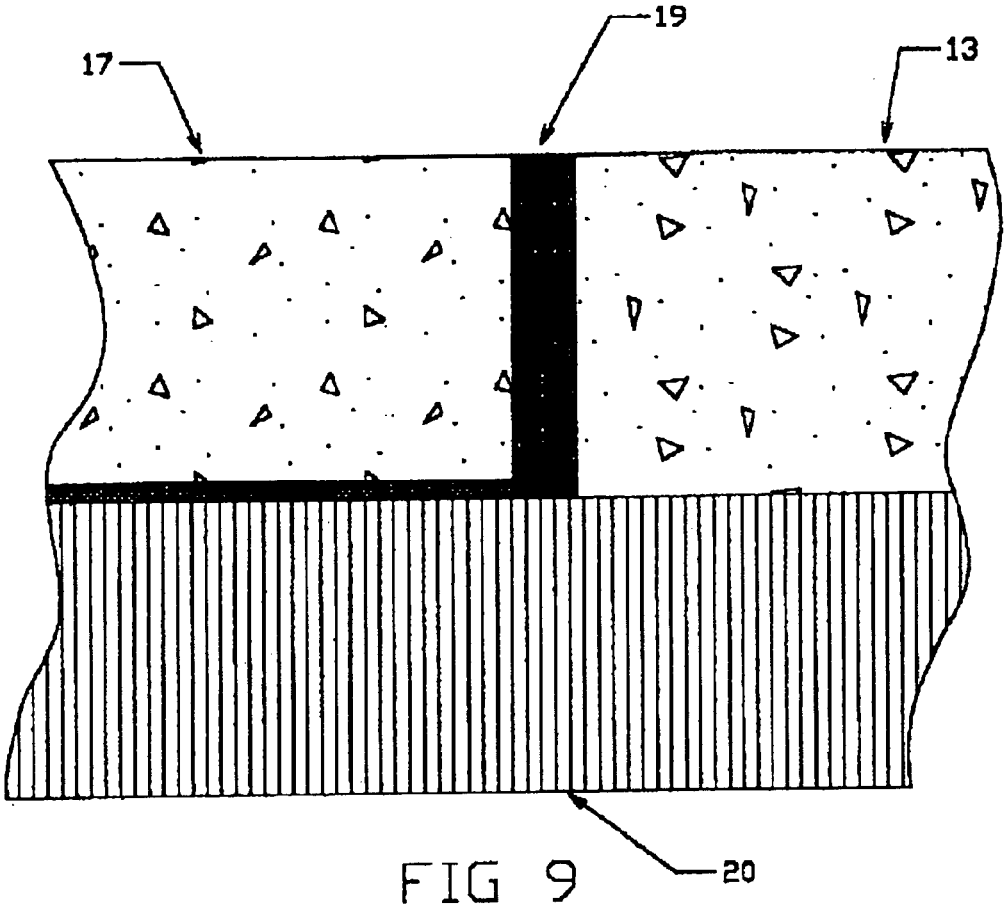
FIG. 9 is a section view through the replaced section at the joint between existing and new rigid pavement with the under bedding and joint filling material shown.

Referring to FIG. 9 the under bedding and joint filling material 19 can now be placed. The under bedding and joint filling material can be one of many materials however a non-shrink, fast setting, "bagged product" (prepackaged in specific proportions where quality control is high and the material can be mixed on site in a small mixer with no quality control problems) is desirable for ease of quality control and better efficiency with short pot life products. As is noticeable in the section view of FIG. 9 the new slab 17 is slightly thinner than the existing rigid pavement 13. This is done to ensure that the base material 20 is not detrimentally affected by the replacement operation. The new slab material can be produced of higher strength material to make up for this smaller dimension or the strength of the under bedding material can also be produced to be significantly stronger than the original material thereby the net effect is actually greater inherent strength in the replacement slab sections than in the original rigid pavement being replaced. Starting on the low side of the slab 17, the under bedding material can be pumped or funneled into the joint where it will rise naturally to the high side, pushing out any air (this is critical to ensure 100% contact bearing with the base 20). Next the joints can be filled with a lower slump mixture of the same material. Now in about the time the it takes to remove broken slabs with current methods, the replacement slab is ready to have the frame removed. The slab can be put back into service very quickly (often within minutes) depending on the projected loads and how hot of a mix (fast setting) was used to under bed and fill the joints.

Figure 14:
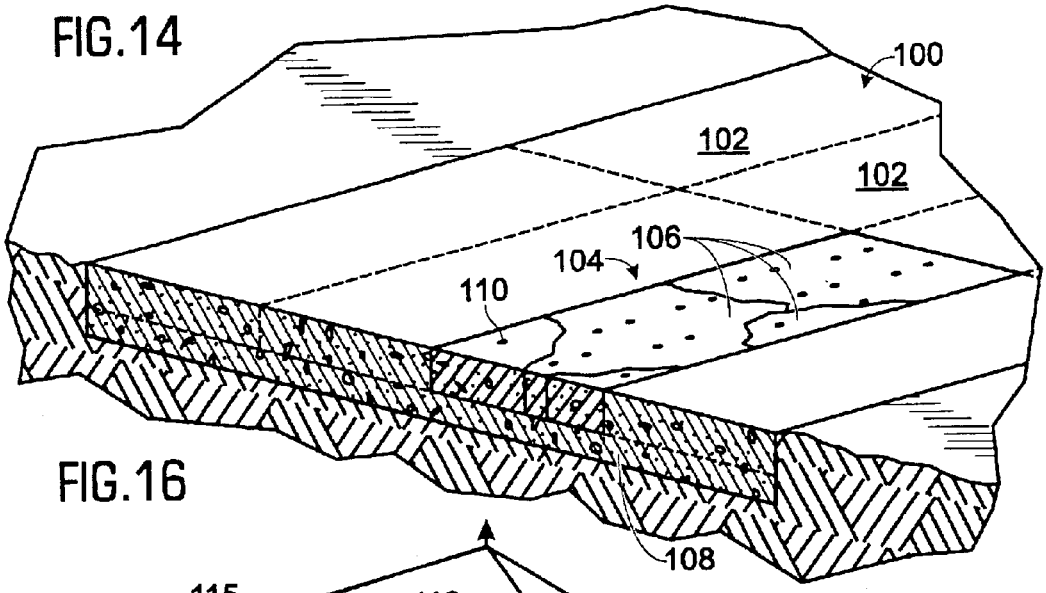
FIG. 14 is a isometric sectional view of a pavement section including a broken slab.
Figure 16:
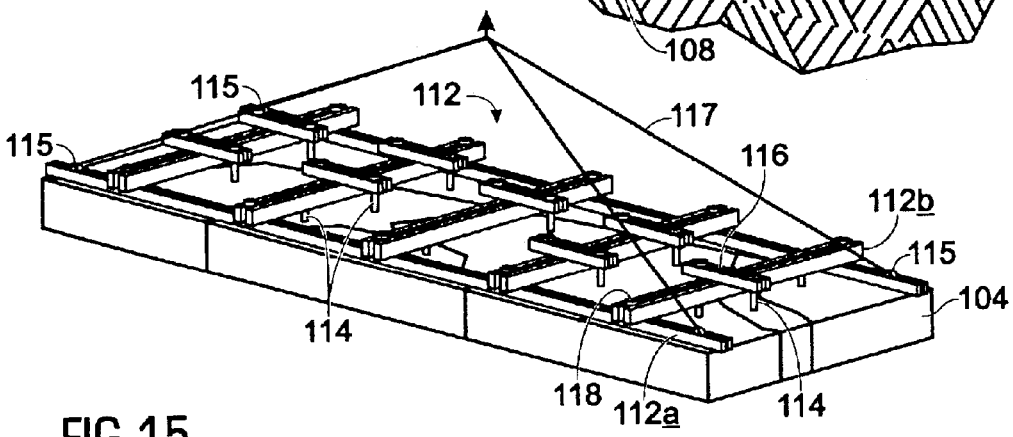
FIG. 16 is an isometric view of the frame of FIG. 15 being hoisted as a unit with the broken slab of FIG. 14.
Figure 15:
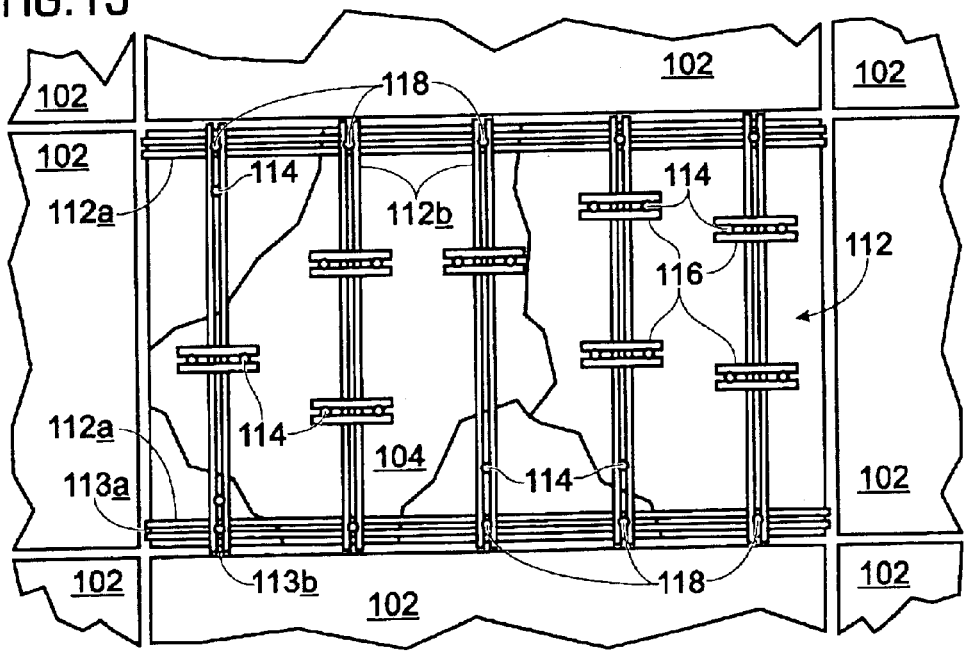
FIG. 15 is a top view of a frame installed on a broken slab, according to one embodiment of the present invention.

FIGS. 14–23 illustrate a method for moving a rigid slab, according to one embodiment of the present invention. FIGS. 14–16 relate to removal of a broken slab, while FIGS. 17–23 relate to installation of a replacement slab. FIG. 14 shows a pavement section 100 including a broken slab 104 surrounded by a plurality of adjacent slabs 102. Broken slab 104 is fractured into a plurality of broken sections 106. Typically, pavement section 100 is a road that is built upon earth or other subjacent material 108, but alternatively may be a bridge, highway runway, etc. Typically, slabs 102, 104 are rigid concrete slabs, although rigid slabs of other suitable cementitious material, or other suitable rigid material may also be used.

According to one embodiment of the present invention, the method includes installing a plurality of anchors 110 in a concrete slab. Typically the anchors are installed into a substantially planar upper surface of the slab, and extend into an interior of the slab. The anchors are typically installed into holes drilled into the concrete slab. Expansion anchors, epoxied anchors, adhered anchors, or a wide variety of other commercially available anchors may be used for this purpose. Alternatively, the anchors may be embedded within the slab at the time the slab is cast, similar to anchor 16 in FIG. 8. These anchors are referred to as cast-in-place embedded anchors. For broken slabs, typically at least one anchor is installed in each broken section 106 of the slab. The anchors may be installed substantially at the centroid of each broken section, or in another suitable location, such as in a middle region of the upper surface of each slab. Each anchor is typically rated for a predetermined weight limit, and a plurality of anchors may be used for certain broken sections 106, such as heavier or unbalanced broken sections.

To install the anchors in the slabs, holes are first predrilled at predetermined locations on the upper surface of each slab. The anchors may be secured into the holes using epoxy or other adhesive, or the anchors may be mechanically secured, for example, using expansion anchors that feature an expanding portion at their tip to inhibit removal. Typically, for broken slabs, at least one hole is drilled and at least one anchor installed in each broken section 106.

Referring to FIGS. 15 and 16, the method further includes installing a frame 112 adjacent the upper surface of the broken slab. Frame 112 is similar to the frame shown in FIGS. 1–13, with certain differences noted below. As described above, the frame is typically installed such that respective portions of the frame are adjacent each of the anchors positioned in the broken sections. Typically, the frame is installed beam by beam, such that lower beam members 112*a* are first laid against the slab, and upper beam members 112*b* are next positioned on top of the lower beam members. The beams are typically fastened together using connectors 118, typically pin connectors of the type described above. The locations of the upper and lower beam members of the frame 112 may be adjusted such that each anchor may be secured to a portion of the frame, via an attachment assembly 114 including various attachment devices. The attachment devices may include coil rod or other threaded connectors that extend through slots in the beams, and nuts and washers to secure the ends of the rods and threaded connectors. Rivets, welds, bolts, wire, or other suitable attachments devices may alternatively be used. As described above, each of the frame members typically has a slot 113*a*, 113*b*, formed its approximate center, through which attachment assembly 114 or connectors 118 may be inserted, allowing the different frame members to be attached together in various orientations, such that they are positioned adjacent each of the anchors in broken slab 106. For greater flexibility, a third level of transverse beams 116 positioned on top of transverse beams 112*b* may be also used, as shown in FIG. 14.

Figure 21:
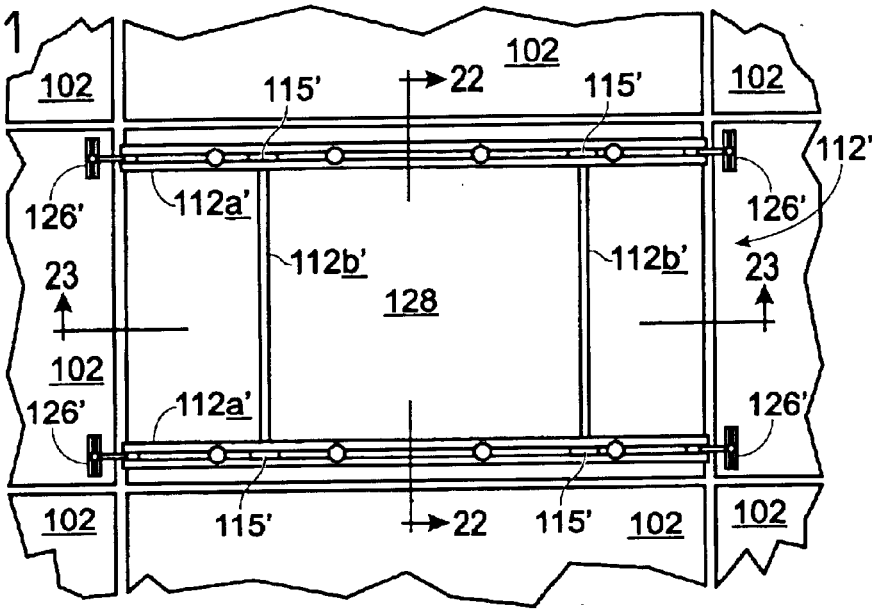
FIG. 21 is a top view of the frame of FIG. 19, shown installed on the replacement slab of FIG. 18, the frame and replacement slab being positioned in the void left by removal of the broken slab shown in FIG. 16.

Typically the lower the frame members 112*a* are placed longitudinally along the slabs, and the upper frame members 112*b* are placed transversely, such that the upper and lower frame members intersect at intersections. Each frame member may be formed of C shaped members spaced apart by a slot 113*a*, 113*b*, spacers being placed at intervals within the slot, as shown in FIG. 21. Where the frame members intersect, barrels are formed through which the connectors 118 may be inserted, as described above.

The method further includes attaching the frame to the anchors via a plurality of attachment assemblies. Each attachment assembly typically securely connects one of the anchors to a corresponding portion of the frame, to thereby secure the frame to the slab. As discussed above, the attachment assemblies typically include various attachment devices, including an attachment device selected from the group consisting of a coil rod or threaded connector, as well as nuts, and associated washers. Thus, the method typically includes tightening each attachment assembly to secure the frame to the slab.

Before lifting the slab, the method may include cutting a bevel edge along at least one edge of the broken concrete slab to inhibit binding of the slab to adjacent slabs during removal. The bevel edge may be cut around substantially the entire perimeter of the broken concrete slab. A detail view of the bevel cut is shown in FIG. 7.

Upon securing the frame to the slab, the method includes attaching hoist members 117 (typically ropes, straps, bars, or cables) to the frame via hoist attachments 115. The method further includes lifting the slab and frame upward and moving the slab and frame together as a unit, without gripping the slab from the side, as shown in FIG. 15. For broken slabs, this enables the removal of a plurality of broken sections of the slab as a unit, attached to the frame, avoiding the time consuming process of reducing the slab to rubble. The broken slab may be placed directly on a truck for removal.

It will be appreciated that the above described steps of installing anchors to a concrete slab, attaching a frame to the slab via anchors and associated attachment assemblies, and moving the slab and frame as a unit may be practiced both with broken slabs, as well as with unbroken slabs. For unbroken slabs the method has the advantage that the slab is supported by an external frame, thereby reducing or eliminating the need for an internal reinforcement structure in the slab such as rebar, which keeps the slab from cracking under tension caused by bending moments experienced during hoisting and other movement.

The installation of an unbroken replacement slab 128 will now be described with reference to FIGS. 17–23. As shown in FIG. 17, a hole or void 120 is typically left by the removal of the broken slab 104 from the pavement section 100. As shown in FIG. 18, the method typically further includes installing anchors 110 at predetermined locations in replacement slab 128, that will be used to fill void 120. The anchors are typically installed in the replacement slab at spaced-apart locations that balance the weight of the slab, as shown in FIG. 18. As shown in FIG. 17, the method may further include drilling holes and installing anchors 110 in adjacent slabs 102 surrounding void 120 left by removal of broken slab 104.

The method may further include positioning frame 112 adjacent replacement slab 128 with the anchors installed therein, and securing the frame to the anchors of the replacement slab via attachment assemblies 114. Typically the frame is configured such that a portion of the frame is positioned adjacent each of the preinstalled anchors in the replacement slab. As mentioned above, due to the external reinforcement of the frame, the replacement slab need not have (but is not limited from having) an internal reinforcing structure.

As shown in FIG. 20, the method may further include installing longitudinal extensions 126*a* and lateral extensions 126*b* to the lower and upper beams respectively. With the extensions installed, the frame and replacement slab 128 may be hoisted as a unit via hoist members 117 that are attached to the frame by hoist attachments 115. The replacement slab may be placed in a void 120 left by the removed broken slab, adjacent existing slabs 102. The extensions extend outside of a perimeter of the replacement slab, and may be placed to rest on adjacent slabs 102. Typically extensions 126*a* are placed directly on the adjacent slabs, while extensions 126*b* are placed on support blocks 124, which rest on the adjacent slabs. Extensions 126*a*, 126*b* serve to align and supper the replacement slab. The extensions are configured to align the replacement slab such that the upper surface of the replacement slab is substantially co-planar with the upper surfaces of the adjacent slabs, to ensure a smooth driving surface for the roadbed. The extensions are configured to support the replacement slab by placing all or part of the weight of the replacement slab on the adjacent slabs.

Figure 22:
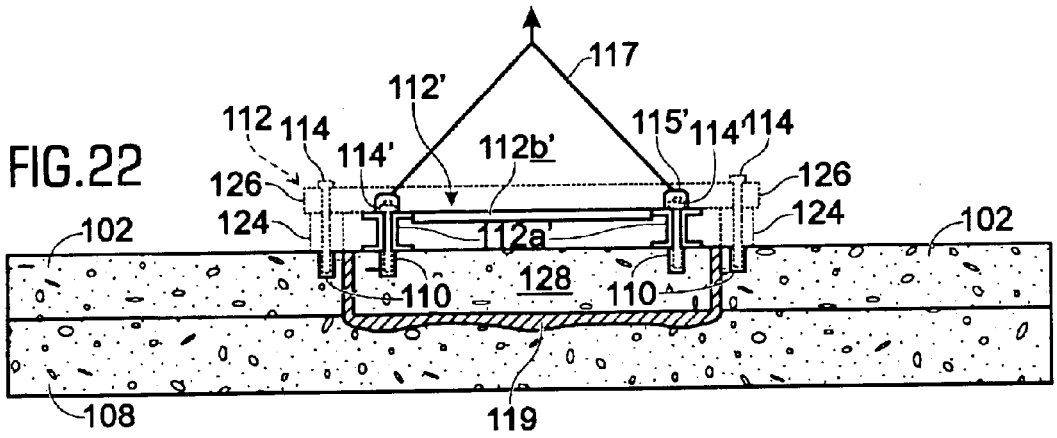
FIG. 22 is a transverse cross sectional view of the frame of FIG. 21, shown installed on the replacement slab.

An alternative embodiment of a frame for use in installation of replacement slabs is shown at 112' in FIG. 21. Frame 112' includes lower or longitudinal frame members 112*a*' that are similar to those of frame 112. However, transverse frame members 112*b*' differ in many respects from those of frame 112. Transverse members 112*b*' are typically formed of hollow pipe or bar and do not include a central slot, although other suitable elongate structures resistant to buckling may be used. One purpose of transverse frame members 112*b*' is to prevent inward rotation of the longitudinal frame members, induced by the angled upward pulling of the hoist members 117, which may bend attachment assemblies 114, causing the assemblies or the concrete slab itself to crack and fail. To maximize this preventative effect, transverse members 112*b*' are typically positioned inwardly adjacent of hoist attachments 115', adjacent an upper lip of the inward C-channel of frame member 112*a*, as shown in FIG. 22. Frame 112' typically includes longitudinal extensions 126', similar to extensions 126*a*, described above. Although not shown, transverse extensions similar to 126*b* may also be used with frame 112' for particularly long slabs, to prevent sag in the middle of the slab.

Figure 23:
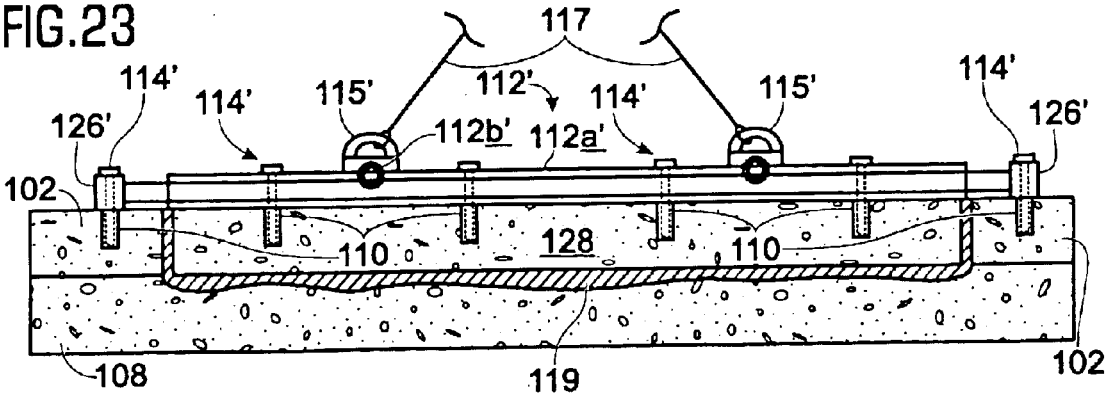
FIG. 23 is a longitudinal cross sectional view of the frame of FIG. 21, shown installed on the replacement slab.

The remainder of the method will be described with reference to frame 112', referring to FIGS. 22 and 23, although it will be appreciated that frame 112 and frames of other configurations may also be used. The method further includes securing frame 112' to the adjacent slabs, typically by bolting down the extensions 126' to the adjacent slabs using anchors 110 installed in the adjacent slabs 102, and associated attachment assemblies 114' for attaching the anchors to the extensions. Securing the frame to adjacent slabs increases the ability of the slab to resist uplift caused by underbedding, as discussed below. Where a frame such as 112 is used, the method may include securing both the transverse and longitudinal beams to adjacent slabs adjacent to the sides and ends of the replacement slab, via longitudinal and transverse extensions 126*a*, 126*b*, as shown in FIG. 20. Alternatively, where a frame such as 112' is used, the method may include only securing the longitudinal beams to adjacent slabs adjacent to ends of the replacement slabs, via longitudinal extensions 126', as shown in FIG. 21. Alternatively or in addition to securing the extensions to the adjacent slabs, the method may include placing one or more additional weights on the frame or replacement slab, to thereby increase the overall weight available to resist uplift of the replacement slab. A wide variety of objects may be used as weights, such as beams, sandbags, vehicles, persons, or other materials or equipment at the construction site.

Underbedding and joint filler material, shown at 119 in FIG. 22, is typically inserted underneath the replacement slab while the frame is secured to adjacent slabs, and/or while the additional weights are on the replacement slab and frame. The underbedding material may be grout, foam, or other suitable material, as discussed above. The underbedding material is installed to fill gaps between the slab and the road bed, and between the replacement slab and adjacent slabs. As described above the subjacent layer or roadbed 108 is typically an underlying layer of aggregate, pavement, or concrete. Underbedding foams typically expand and cause uplift, and underbedding grout typically is pumped in at pressure, and may also cause uplift. If this uplift is too great, the replacement slab may shift out of position. Securing the frame to adjacent slabs and/or placing weights on the frame and slab not only aligns the upper surface of the replacement slab with the adjacent slab surfaces, but also provides additional downforce to resist this uplift. As a result, the replacement slab is inhibited from rising or moving when the underbedding material is inserted, and the underbedding material sets more quickly and more densely (i.e., more material and fewer gas bubbles per unit volume), making it stronger. Once the underbedding material is set, the frame is removed from the slab, and the roadbed is ready for traffic.

In addition to or as an alternative to the extensions, the adjacent concrete slabs may be attached to the replacement slab via one or more joints, as shown in FIG. 11. As described in detail above, the joint may include a dowel with one end installed into the existing concrete slab. The joint may further include a reduction cavity block-out into which the dowel is secured using a joint filler material. The reduction cavity block-out may include an upper portion with upwardly and outwardly sloping walls, to inhibit trapping of bubbles in the joint filler material. Alternatively, the reduction cavity block-out may include sides that are skewed inward to inhibit longitudinal separation of the replacement slab from the existing concrete slab once the joint filler material is cured.

While the examples of the different configurations and methods of use for the device described with reference to the accompanying drawings have met the objective of the present invention, it will be appreciated by those skilled in the art that many alterations and additions can be made without departing from the scope of the invention as defined by the following claims. For example, it is not essential that the beams be steel or even C-channels, or that the beams be stacked rather than welded in the same plane, or that bolting the beams rather than welding or pinning them is outside the scope of the current invention. Likewise devices for lifting the frame could be other than crane or fork lift. They could be placed with jacks and casters, mobile trailers, or various other means. In addition, a wide variety of different attachment assemblies and anchors could be used. A number of alternative bedding base materials, which would satisfy constraints of individual projects, could be employed without departing from the scope of the invention.

What is claimed is:

1. A method for use in moving a concrete slab, the method comprising:

installing a plurality of anchors through an upper surface into an interior of a concrete slab;

installing a frame adjacent the upper surface of the concrete slab, wherein the frame includes one or more extensions adapted to extend outside of a perimeter of the concrete slab;

attaching the frame to the anchors via a plurality of attachment devices; and moving the frame and the concrete slab substantially simultaneously as a unit.

2. The method of claim 1, wherein the concrete slab is a replacement slab, and wherein moving the frame and replacement concrete slab includes moving the frame and replacement concrete slab into a space adjacent an existing concrete slab, the method further comprising, aligning and supporting the replacement concrete slab by placing one or more extensions of the frame on the existing concrete slab.

3. The method of claim 2, wherein the concrete slab is a replacement slab, and wherein the frame includes upper and lower beam members, the method further comprising placing a support beam block on the existing adjacent slab and aligning the replacement slab by placing a portion of one or more of the upper beam members on the support beam block.

4. The method of claim 2, further comprising:

inserting underbedding material underneath the replacement slab while the frame is resting on the existing adjacent slab.

5. The method of claim 4, further comprising:

placing weights on at least one of the frame and replacement slab; and inserting underbedding material underneath the replacement slab while the weights are in place.

6. The method of claim 2, further comprising:

securing the extension of the frame to the adjacent slab via a fastener.

7. The method of claim 6, further comprising:

inserting underbedding material underneath the replacement slab while the frame is secured to the existing adjacent slab.

8. The method of claim 4, further comprising:

removing the frame from the replacement slab after the underbedding material has at least partially cured.

9. The method of claim 1, wherein the concrete slab is a broken concrete slab including a plurality of broken concrete pieces, wherein the frame has adjustable frame members, the method further comprising:

installing at least one concrete anchor in each of the broken pieces.

10. The method of claim 9, further comprising cutting a bevel cut at least partially around a perimeter of the broken concrete slab to inhibit binding of the slab to adjacent slabs during removal.

11. The method of claim 10, wherein each of the attachment devices includes a connector selected from the group consisting of a coil rod and threaded connector.

12. The method of claim 11, wherein the frame members include a plurality of slots, and a pin connector is inserted through each slots to secure the frame members to each other.

13. The method of claim 12, wherein the frame members include spacers positioned adjacent the pin connectors within the slots.

14. The method of claim 13, wherein the frame members include longitudinal frame members and transverse frame members that intersect at intersections, the slots and spacers of the intersecting frame members at each intersection forming barrels through which the pin connectors are inserted.

15. The method of claim 14, wherein the frame members are formed by two C-shaped structures separated by one or more of the spacers.

16. The method of claim 9, wherein the broken concrete slab is moved from a position next to an adjacent slab, thereby forming a void, the method further comprising:

detaching the frame from the broken concrete slab;

positioning the frame adjacent a replacement slab having anchors installed therein; and securing the frame to the anchors of the replacement slab.

17. The method of claim 16, wherein the replacement concrete slab does not include an internal reinforcing structure.

18. The method of claim 16, method further comprising moving the replacement slab into the void next to the adjacent slab.

19. The method of claim 18, further comprising aligning and supporting the replacement slab by placing an extension on an adjacent slab.

20. The method of claim 19, further comprising placing a weight on at least one of the frame and the replacement slab.

21. The method of claim 19, further comprising securing the extension to the adjacent slab.

22. The method of claim 21, wherein the extension is secured to the adjacent slab via an anchor installed in the adjacent slab.

23. The method of claim 22, further comprising placing underbedding material under the replacement slab.

24. The method of claim 23, wherein the underbedding material is selected from the group consisting of foam and grout.

25. The method of claim 24, further comprising removing the frame from the replacement slab, after the underbedding material has at least partially cured.

26. The method of claim 19, wherein the frame includes upper and lower beam members, the method further comprising placing a support beam block on an adjacent slab and aligning the replacement slab by placing the upper beam members on the support beam block.

27. The method of claim 18, further comprising attaching the adjacent slab to the replacement slab via at least one joint.

28. The method of claim 27, wherein the joint includes a dowel with one end installed into the existing concrete slab.

29. The method of claim 28, wherein the joint further includes a reduction cavity block-out into which the dowel is secured using a joint filler material.

30. The method of claim 29, wherein the reduction cavity block-out includes an upper portion with upwardly and outwardly sloping walls, to inhibit trapping of bubbles in the joint filler material.

31. The method of claim 29, wherein the reduction cavity block-out includes sides that are skewed inward to inhibit longitudinal separation of the replacement slab from the existing concrete slab once the joint filler material is cured.

32. The method of claim 2, wherein the replacement concrete slab has no internal reinforcing structure.

33. The method of claim 2, further comprising, securing the one or more extensions to the existing slab.

34. The method of claim 33, further comprising, placing underbedding material under the replacement concrete slab.

35. The method of claim 34, wherein the underbedding material is at least partially cured while the one or more extensions are attached to the existing slab.

* * * * *

UNITED STATES PATENT AND TRADEMARK OFFICE

CERTIFICATE OF CORRECTION

PATENT NO. : 6,752,566 B2
APPLICATION NO. : 10/455117
DATED : June 22, 2004
INVENTOR(S) : William Bruce Smith It is certified that error appears in the above-identified patent and that said Letters Patent is hereby corrected as shown below:

On the Title Page, Item (75) should read,
Inventor: William M. Drake, Marysville, CA (US)
William Bruce Smith, Yuba City, CA (US)

Signed and Sealed this

Thirty-first Day of March, 2009

John Doll

JOHN DOLL
*Acting Director of the United States Patent and Trademark Office*